United States Patent [19]

Sykes et al.

[11] Patent Number: 4,555,023

[45] Date of Patent: Nov. 26, 1985

[54] DRUM CONTAINERS

[75] Inventors: Donald J. Sykes, Upper Saddle River, N.J.; Gary E. Gendron, Boiceville, N.Y.

[73] Assignee: Marpac Industries, Inc., Waldwick, N.J.

[21] Appl. No.: 734,082

[22] Filed: May 14, 1985

[51] Int. Cl.[4] ..... B65D 85/20; B65D 85/30; B65D 81/02

[52] U.S. Cl. ..... 206/446; 220/4 B; 220/339

[58] Field of Search ..... 206/446, 409; 220/4 B, 220/339

[56] References Cited

U.S. PATENT DOCUMENTS

| | | | |
|---|---|---|---|
| 852,010 | 4/1907 | Wright | 206/446 |
| 2,401,842 | 6/1946 | Slater | 206/409 |
| 2,639,807 | 5/1953 | Ambrette et al. | 206/446 |
| 2,828,857 | 4/1958 | MacKay | 206/446 |
| 3,939,967 | 2/1976 | Tenney et al. | 206/446 |
| 4,109,790 | 8/1978 | Gottschlich | 206/446 |

*Primary Examiner*—William T. Dixson, Jr.
*Attorney, Agent, or Firm*—Samuelson & Jacob

[57] ABSTRACT

Containers for containing a drum having a sensitive cylindrical outer surface, each container utilizing a relatively thin-walled construction including a body with side walls establishing a polygonal cross-sectional configuration within which the drum is suspended by supports engaging the drum adjacent the ends thereof such that contact with the sensitive outer surface of the drum is avoided, the interior of each container being sealed by an air-resistant seal to isolate the interior of the container from the surrounding environment while establishing an air cushion for reinforcing the thin-walled body against external forces so as to preclude damaging contact between the side walls and the sensitive outer surface of the drum.

10 Claims, 9 Drawing Figures

DRUM CONTAINERS

The present invention relates generally to specialized containers and pertains, more specifically, to containers for handling, shipping and storing drums having sensitive outer surfaces, such as those employed in photocopy machines and electrostatic printing machines.

Currently popular photocopy machines and electrostatic printing machines utilize, as a central operating component, a drum having a photoconductive outer surface. Usually, these drums are constructed of a lightweight metal, such as aluminum, and the outer surface is coated with a photosensitive material, such as selenium or cadmium sulfide. The nature of the construction and the materials employed in these drums renders the drums susceptible to damage, especially during shipping and storage. Caution must be exercised in avoiding undue stress on the aluminum body of the drum and all contact with the coated surface should be avoided. At present, these drums are being packaged in ordinary cardboard containers which raise the possibility that paper fibers will contaminate the sensitive coated surfaces. Such contamination is combated through the use of supplemental polyethylene bags into which the drums first are placed. But the bags themselves can rub against and injure the coated surfaces.

An object of the present invention is to provide containers for storage, shipment and the general handling of drums of the nature described above, and which enable a higher degree of protection against damage to the drums contained therein.

Another object of the invention is to provide containers of the type described and in which the drums are suspended within a protective envelope, without the necessity for packaging materials making contact with the sensitive surfaces of the drum, while enabling protection against otherwise damaging shocks, as well as contamination of the sensitive surfaces.

Still another object of the invention is to provide containers of the type described and which are simple in construction, for ease of manufacture and use, and are easily manufactured of relatively inexpensive materials so as to be economical to use, and can be disposed of easily, safely and economically.

Yet another object of the invention is to provide containers of the type described and which reduce contamination of the environment in which the drums are used and discarded.

A further object of the invention is to provide containers of the type described and which require a minimum of space during storage and transport, while enabling increased protection against damage of the contents.

A still further object of the invention is to provide containers of the type described and which are inexpensive enough to be used in large quantities and to be expendable.

The above objects, as well as still further objects and advantages, are attained by the present invention which may be described briefly as a container for containing a drum, the drum having a longitudinally-extending sensitive cylindrical outer surface and opposite end journals, the container comprising: a longitudinally-extending, relatively thin-walled container body having opposite end walls and a plurality of essentially flat side walls extending longitudinally between the end walls to define a container interior, with adjacent side walls intersecting one another to establish reinforcing corners and a polygonal cross-sectional configuration having apexes located at the reinforcing corners; support means in the end walls for supporting the end journals of the drum so as to support the drum in a suspended position within the interior of the container body with the cylindrical outer surface of the drum spaced form the side walls of the container body; the container body including an opening for admitting the drum into the container, and at least a first body portion and a second body portion, the first body portion being selectively engageable with the second body portion for closing the opening to contain the drum within the container body; securing means associated with at least one of the first and second body portions for securing the drum in said suspended position upon engagement of the first body portion with the second body portion to close the opening; and sealing means associated with the first and second body portions for sealing the opening, with an air-resistant seal so as to establish an air cushion within the interior of the container body upon engagement of the first body portion with the second body portion to close the opening; the air cushion and the reinforcing corners being effective to maintain the spacing between the cylindrical outer surface of the drum and the side walls of the container body so as to preclude damaging contact between the side walls of the container and the sensitive cylindrical outer surface of the drum.

The invention will be understood more fully, while still further objects and advantages will become apparent, in the following detailed description of preferred embodiments illustrated in the accompanying drawing, in which.

Figure 1:
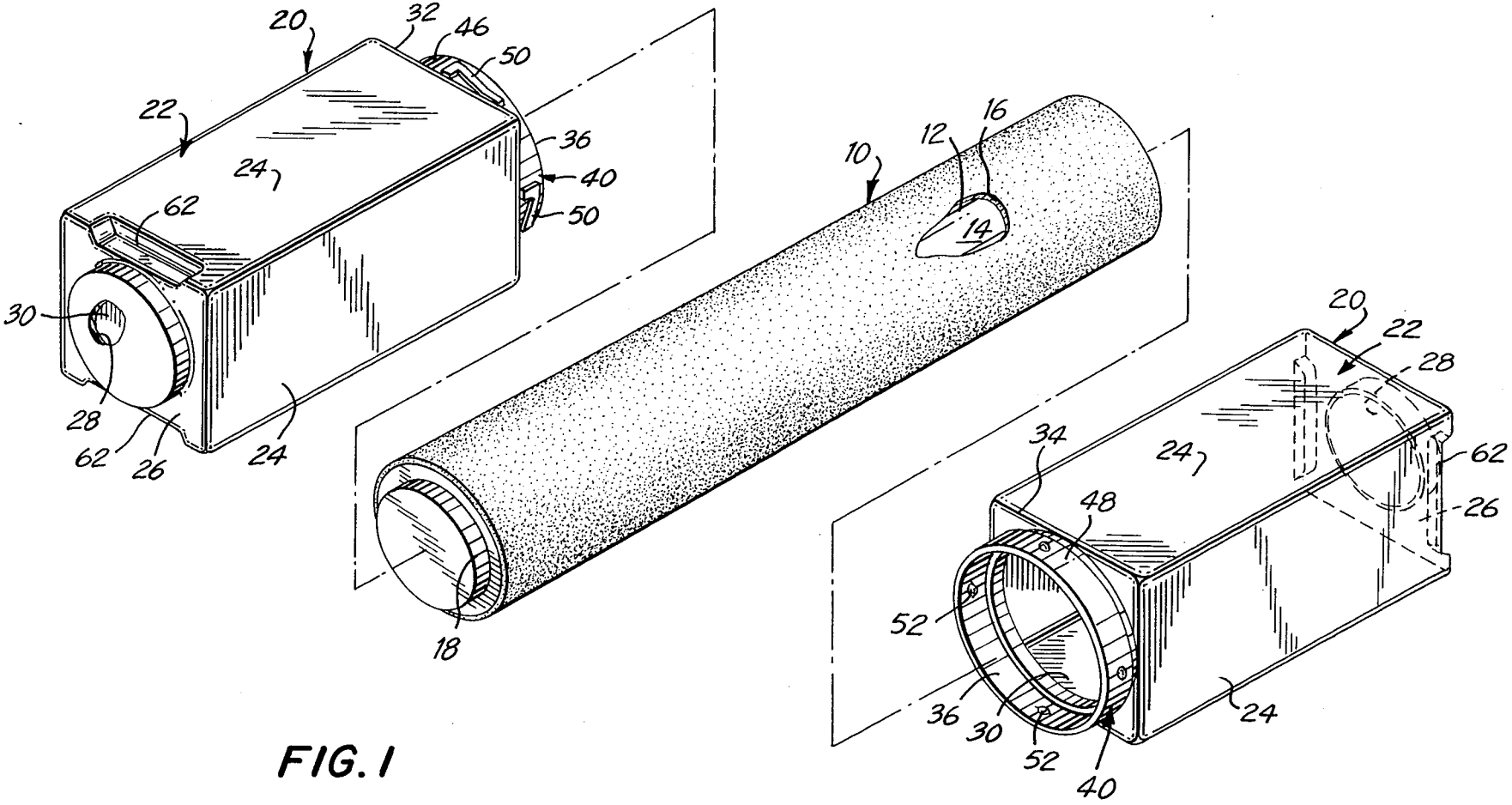
FIG. 1 is an exploded perspective view illustrating a container constructed in accordance with the invention and a drum to be packaged in the container.

Referring now to the drawing, and especially to FIG. 1 thereof, a drum for use in a photocopy machine or an electrostatic printing machine is illustrated at 10 and is seen to have a generally cylindrical wall 12 constructed of a lightweight material, such as aluminum, the outer surface 14 of which is coated with a photoconductive coating 16, of a material such as selenium, cadmium sulfide or an equivalent material. Drum 10 has a journal 18 at each end, each journal 18 also being cylindrical. In this instance, both journals 18 are of the same diameter.

Drum 10 is to be packaged in a container 20, constructed in accordance with the invention, in which container 20 the drum 10 will be protected against shocks and other impacts associated with transportation and storage of drum 10, and the outer surface 14, with its sensitive coating 16, will be protected against damaging contact as well as against contamination. To these ends, container 20 has a longitudinally-extending container body 22 including side walls 24 and end walls 26. Each end wall 26 has a recess 28 opening toward the interior 30 of the container 20 and each recess 28 is complementary to a corresponding journal 18 of the drum 10. Container 20 is a two-part construction, having a first portion 32 and a second portion 34 capable of being coupled together to close the opening between them, established at the mouth 36 of each portion 32 and 34, and contain the drum 10.

Figure 2:
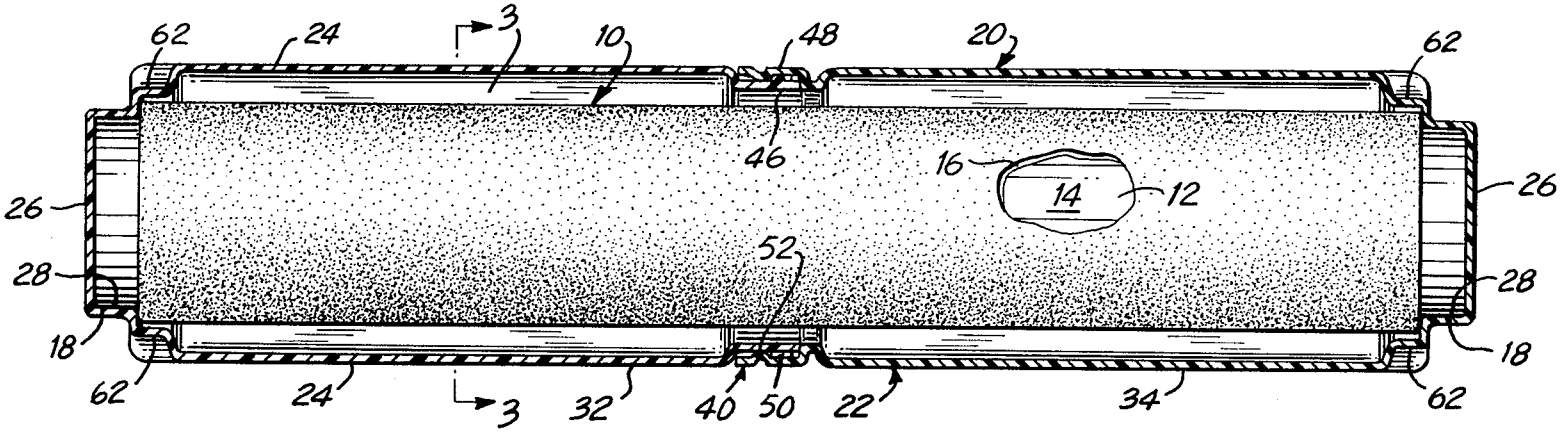
FIG. 2 is a longitudinal cross-sectional view of the container, assembled with the drum contained therein.

Turning now to FIG. 2, in order to contain drum 10 within container 20, the mouth 36 of each portion 32 and 34 of the container 20 is placed over a corresponding end of the drum 10 and the portions 32 and 34 are moved toward one another until a coupling 40 is engaged to couple the portions 32 and 34 together, thereby closing the opening between the portions, with the journals 18 of the drum 10 seated within corresponding recesses 28, as illustrated. The drum 10 is then suspended within the interior 30 of the container 20 by the engagement of journals 18 within recesses 28 in the completed assembly of the portions 32 and 34 of container 20.

Figure 3:
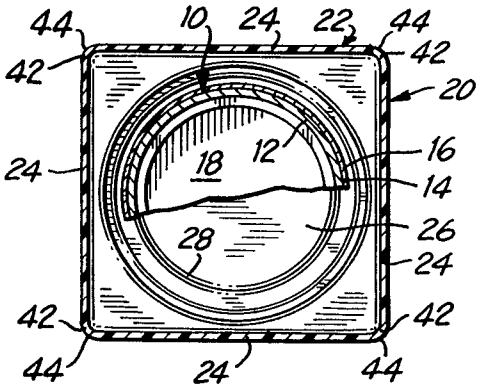
FIG. 3 is a lateral cross-sectional view taken along line 3—3 of FIG. 2, with portions of the drum broken away.

As best seen in FIG. 3, the periphery of the container body 22 is greater than the circumference of the cylindrical wall 12 of the drum 10 and is configured such that the side walls 24 are spaced from the outer surface 14 of the drum 10. Not only is the periphery of the container body 22 greater than the circumference of the cylindrical wall 12 of the drum 10, but the cross-sectional configuration of the container body 22 is in the form of a polygon having a plurality of apexes 42 at the intersections of the flat side-walls 24. In this instance, the polygon essentially is a square and each apex is established at a right angle made between intersecting side walls 24. The apexes 42 extend longitudinally along the greatest portion of the length of container 20 and serve to establish reinforcing corners 44 which reinforce the container body 22 against inward movement in response to external forces applied to the container side walls 24. Thus, the polygonal configuration, in this instance the illustrated preferred essentially square configuration, provides a relatively simple reinforcing structure enabling greater strength with a relatively thin-walled construction.

Container 20 advantageously is constructed of a molded synthetic resin material enabling light weight and economy. The synthetic resin material preferably is rendered opaque to protect the light-sensitive coating 16 of the drum 10. A typical container 20 designed for containing a standard drum 10 is molded of high density polyethylene having a wall thickness of about ten-thousandths of an inch, an overall length of about twelve inches and a periphery of about sixteen inches, each side wall extending along about four inches of the periphery. Preferably, the two portions 32 and 34 are of essentially equal length, with coupling 40 located longitudinally centrally between end walls 26, so that the molds for constructing the portions are kept to minimum dimensions; however, the portions 32 and 34 need not be of equal length in order to function as desired.

Figure 4:
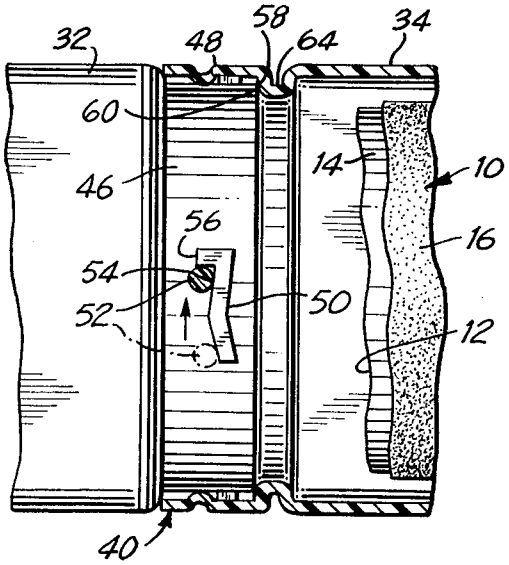
FIG. 4 is an enlarged, fragmentary view of a portion of the container.

Referring now to FIG. 4, as well as to FIGS. 1 and 2, coupling 40 serves several functions. In addition to securing together the portions 32 and 34 into an integral container 20, coupling 40 accomplishes the appropriate alignment of the portions 32 and 34 relative to one another, the appropriate length between the recesses 28 in end walls 26 to accommodate and secure the drum 10 suspended within the container 20, and a desired seal. Coupling 40 includes an inner sleeve 46, molded unitary with portion 32, and an outer sleeve 48, molded unitary with portion 34, both the inner and outer sleeves 46 and 48 being generally cylindrical. Inner sleeve 46 carries a plurality of raised cam tracks 50 and outer sleeve 48 includes a corresponding number of radially inwardly directed follower projections 52 spaced around the periphery of the sleeves 46 and 48, respectively. In order to engage coupling 40, inner sleeve 46 is telescoped into outer sleeve 48 and each follower projection 52 is engaged with a corresponding cam track 50, as shown in phantom in FIG. 4. Upon turning portion 32 relative to portion 34, in the direction of the arrow in FIG. 4, follower projections 52 will ride along cam tracks 50 drawing the inner and outer sleeves 46 and 48 into further telescoping engagement until each follower projection 52 reaches a land 54 and abuts a stop 56 adjacent land 54.

At the same time, the terminal end 58 of inner sleeve 46 is seated against a shoulder 60 at the inner end of outer sleeve 48 to lock the sleeves 46 and 48 together and complete coupling 40. The relative location of stops 56 and follower projections 52 assure that the two portions 42 and 34 are secured together in appropriate alignment; that is, corresponding side walls 24 of the portions 32 and 34 lie in the same plane so that all of the flat side walls 24 fall within the cross-sectional configuration illustrated in FIG. 3. The flat side walls 24 enable compact stacking of a multiplicity of containers 20 in closely nested arrangement and preclude rolling of the containers 20 during handling, transportation and storage. The corners 44 each are provided with a small radius so as to relieve any stresses at the corners 44 and to assure that should container 20 be dropped on a corner 44, the container 20 merely will roll onto a flat side wall 24 and quickly come to rest. Finger grip depressions 62 are provided adjacent the end walls 26 to facilitate the manipulation of the portions 32 and 34 during assembly and disassembly of the coupling 40, as well as during handling and transportation of the completed container 20.

Appropriate engagement of the coupling 40 joins the two portions 32 and 34 into an integral structure in which the end walls 26, and the recesses 28 therein, are located accurately relative to one another to secure the drum 10 in the desired suspended position within the container 20. Thus, the coupling 40 serves as a securing means to secure the drum 10 in the desired suspended position.

Figure 5:
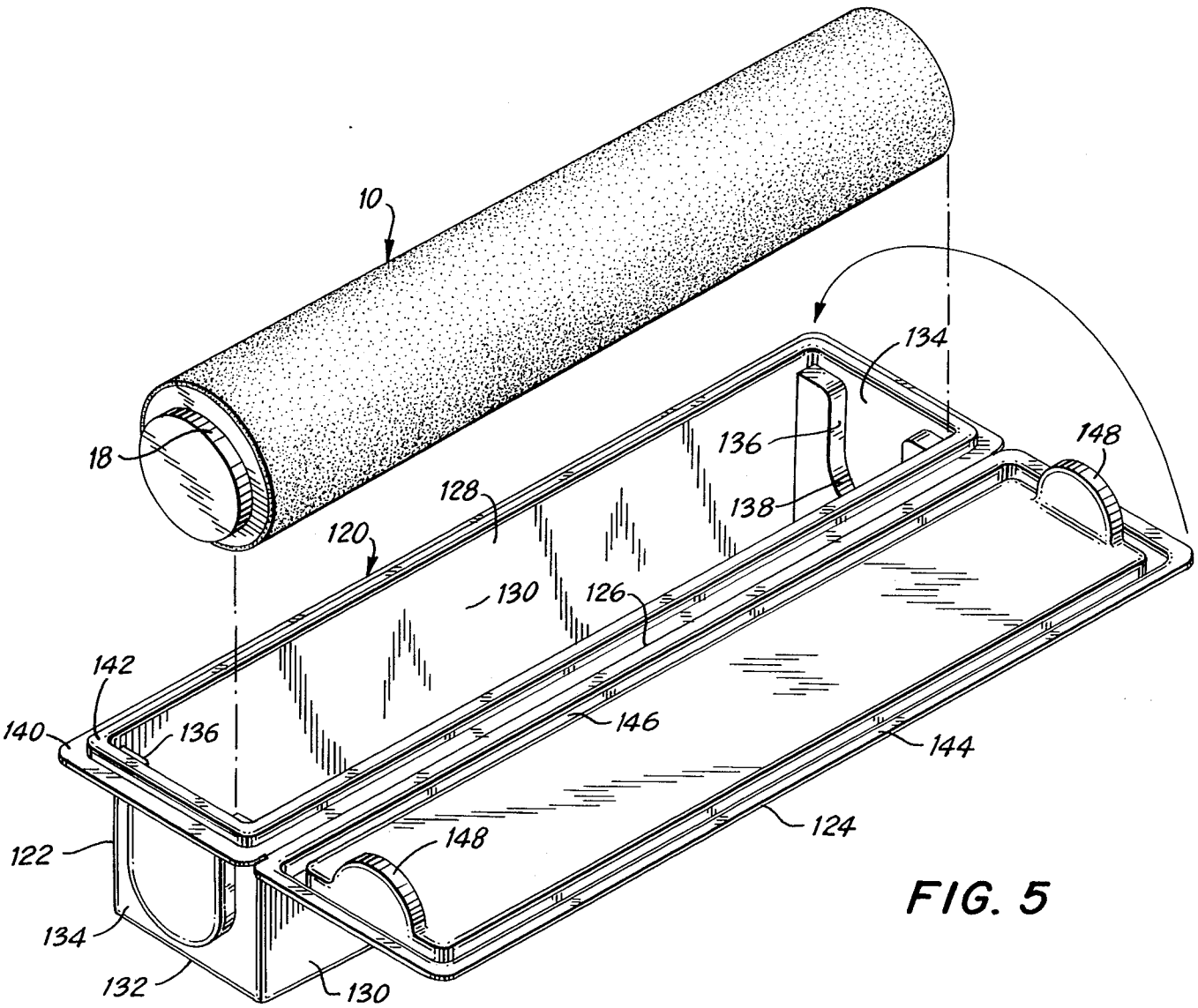
FIG. 5 is a perspective view illustrating another container constructed in accordance with the invention, with a drum about to be packaged therein.

Referring now to FIG. 5, another container constructed in accordance with the invention is illustrated at 120. Container 120 also is a thin-walled structure formed of a synthetic resin material; however, in this instance, container 120 is formed in a unitary structure including a first portion in the form of a case 122 and a second portion in the form of a cover 124. A unitary hinge 126 enables the cover 124 to be folded into sealing position over the opening 128 in case 122. Case 122 has longitudinally-extending side walls 130, a bottom side wall 132 and opposite side walls 134. A U-shaped recess 136 in each end wall 134 is open toward the opening 128 and includes a support surface 138 having a radius complementary to the radius of journal 18 of drum 10.

Figure 6:
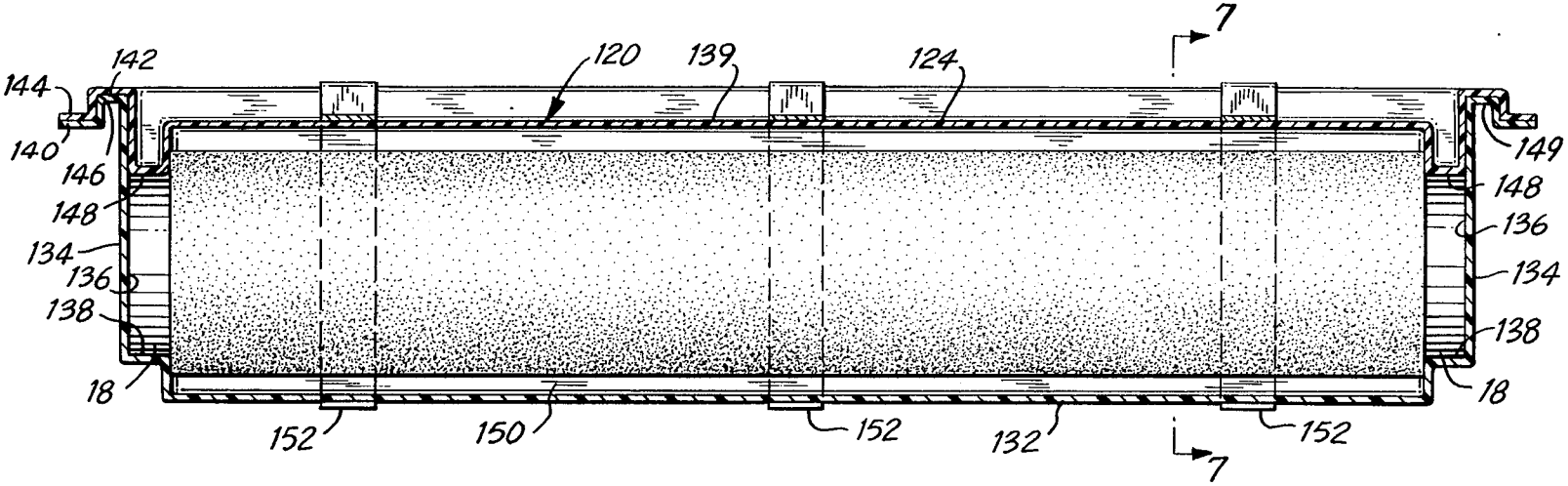
FIG. 6 is a longitudinal cross-sectional view of the container of FIG. 5, with the drum contained therein.
Figure 7:
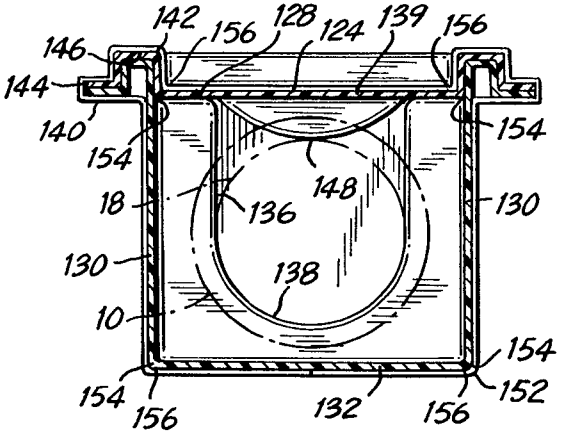
FIG. 7 is a lateral cross-sectional view taken along line 7—7 of FIG. 6, with the drum shown in phantom.

Drum 10 is lowered into case 122 of container 120, through opening 128, with journals 18 placed within recesses 136 and resting upon support surfaces 138. Cover 124 then is swung into place, as indicated by the arrow in FIG. 5, until the case 122 is closed, as seen in FIGS. 6 and 7, so that cover 124 provides a top side wall 139. Case 122 includes a lip 140 which extends laterally outwardly along the perimeter of the opening 128 of case 122 and carries a bead 142. Cover 124 has a skirt 144 and a groove 146 generally complementary to lip 140 and bead 142; respectively, so that upon closing of the case 122, the skirt 144 will be juxtaposed with the lip 140, and bead 142 will enter groove 146, as seen in FIGS. 6 and 7. At the same time, a projection 148 adjacent each end of the cover 124 enters each U-shaped recess 136 and engages the corresponding journal 18 of drum 10 (shown in phantom) to secure the drum 10 in suspended position within the closed container 120.

A relatively tight fit between bead 142 and groove 146 secures the cover 124 in place upon the case 122 while providing and air-resistant seal for sealing the interior 150 of container 120. A relief channel 149 within bead 142 provides a degree of flexibility for enhancing both the securing and the sealing functions of the coupling provided by bead 142 and groove 146. Supplemental means may be provided to maintain the cover 124 in place on the case 122, such as bands 152 of packaging tape wrapped around the periphery of the container 120.

Container 120 provides all of the advantages described above in connection with container 20. Thus, the essentially square cross-sectional configuration provides apexes 154 and reinforcing corners 156 along the length of the container 120, while enabling the side walls 130, bottom wall 132 and cover 124 to the essentially flat for better handling and storage. The interior 150 is sealed against contamination from outside the container 120 as well as against contamination of the surrounding environment from inside the container 120. Drum 10 is suspended by engagement of journals 18 with support surfaces 138 and projections 148, while the cylindrical wall 12 and coating 16 on the outer surface 14 are not contacted by elements of the container. An air cushion is provided by the sealed interior 150 to protect against shocks and other impacts. Container 120, like container 20, is inexpensive to manufacture so that the container finds widespread use and is expendable for convenient, safe, and economical disposal of expended drums.

Figure 8:
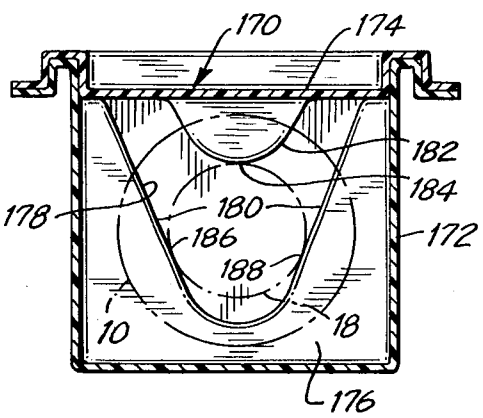
FIG. 8 is a lateral cross-sectional view similar to FIG. 7 but showing an alternate construction.

Turning now to FIG. 8, a modification is illustrated in an alternate container 170 constructed similar to container 120, but with the following exceptions. In container 170 the case 172 is provided with a cover 174 which is separate from the case 172, there being no hinged connection between the case 172 and cover 174. In addition, the end walls 176 are provided with V-shaped recesses 178 having angled support surfaces 180 for supporting the journals 18 of drum 10 (shown in phantom). Upon placing cover 174 in position upon case 172, projections 182 on the cover 174 enter the V-shaped recesses 178 to secure the journals 18 in place by means of a three-point clamping arrangement at points 184, 186 and 188. In this manner, a single case 172 may be used to accommodate drums 10 having journals 18 of different diameters, while only the covers 174 need be modified to provide the appropriate projections 182 for a given journal diameter.

Figure 9:
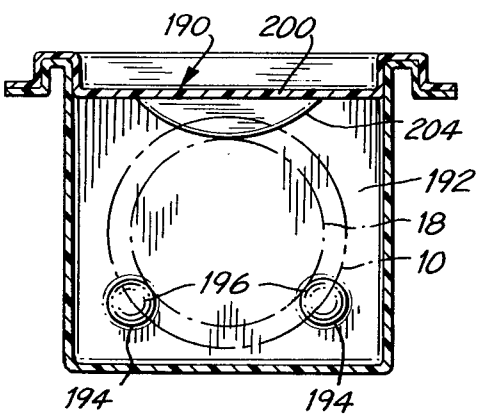
FIG. 9 is a lateral cross-sectional view similar to FIG. 7, but showing another alternate construction.

In the embodiment of FIG. 9, a further modification is illustrated in the form of alternate container 190 constructed similar to container 170, but with the following exceptions. The end walls 192 of the container 190 are provided with inwardly-directed protrusions 194 establishing support surfaces 196 upon which journals 18 are rested. Upon placing cover 200 in place upon case 202, projections 204 on the cover 200 engage the journals 18 to secure the drum 10 (shown in phantom) in place by means of a three-point clamping arrangement provided by each projection 204 and the corresponding protrusions 194. Here again, the case 202 will accommodate drums 10 having journals of various diameters.

It is to be understood that the above detailed description of preferred embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. A container for containing a drum, the drum having a longitudinally-extending sensitive cylindrical outer surface and opposite end journals, the container comprising:

a longitudinally-extending, relatively thin-walled container body having opposite end walls and a plurality of essentially flat side walls extending longitudinally between the end walls to define a container interior, with adjacent side walls intersecting one another to establish reinforcing corners and a polygonal cross-sectional configuration having apexes located at the reinforcing corners;

support means in the end walls for supporting the end journals of the drum so as to support the drum in a suspended position within the interior of the container body with the cylindrical outer surface of the drum spaced from the side walls of the container body;

the container body including an opening for admitting the drum into the container, and at least a first body portion and a second body portion, the first body portion being selectively engageable with the second body portion for closing the opening to contain the drum within the container body;

securing means associated with at least one of the first and second body portions for securing the drum in said suspended position upon engagement of the first body portion with the second body portion to close said opening; and sealing means associated with the first and second body portions for sealing the opening with an air-resistant seal so as to establish an air cushion within the interior of the container body upon engagement of the first body portion with the second body portion to close said opening;

said air cushion and said reinforcing corners being effective to maintain the spacing between the cylindrical outer surface of the drum and the side walls of the container body so as to preclude damaging contact between the side walls of the container and the sensitive cylindrical outer surface of the drum.

2. The invention of claim 1 wherein the polygonal cross-sectional configuration essentially is a square.

3. The invention of claim 2 including a small radius at each apex of the polygonal cross-section.

4. The invention of claim 1, 2, or 3 wherein:

the first body portion includes at least one of said plurality of side walls;

the second body portion includes the remainder of said plurality of side walls and the end walls;

the opening extends longitudinally along the second body portion between the end walls; and the sealing means includes complementary first and second sealing elements extending around the opening to seal the opening with said air-resistant seal when the first and second body portions are engaged with one another.

5. The invention of claim 1, 2, or 3 wherein:

the first body portion includes at least one of the said plurality of side walls;

the second body portion includes the remainder of said plurality of side walls and the end walls;

the opening extends longitudinally along the second body portion between the end walls; and the securing means includes a projection on the first body portion adjacent each end of the one side wall, each projection extending into the second body portion to engage and secure a corresponding journal of the drum upon engagement of the first and second body portions.

6. The invention of claim 5 wherein the sealing means includes complementary first and second sealing elements on the first and second body portions, said first and second sealing elements extending around the opening to seal the opening with said air-resistant seal when the first and second body portions are engaged with one another.

7. The invention of claim 1, 2 or 3 wherein:

the container body is divided intermediate the end walls into the first and second body portions such that each of the first and second body portions includes an end wall; and the opening extends laterally along at least one of the first and second body portions.

8. The invention of claim 7 wherein the sealing means includes complementary first and second sealing elements on the first and second body portions, said first and second sealing elements extending around the opening to seal the opening with said air-resistant seal when the first and second body portions are engaged with one another.

9. The invention of claim 7 wherein:

each of the first and second body portions includes a part of each side wall; and the securing means includes a coupling for joining the first and second body portions such that corresponding parts of each side wall extend in a common plane.

10. The invention of claim 9 wherein the coupling is located longitudinally essentially centrally between the end walls.

* * * *